US008252125B2

(12) United States Patent
Giefers et al.

(10) Patent No.: US 8,252,125 B2
(45) Date of Patent: Aug. 28, 2012

(54) METHOD FOR PRODUCING A WORKPIECE AND A WORKPIECE

(75) Inventors: Hubertus Giefers, Paderborn (DE); Karsten Bake, Salzkotten (DE); Andreas Frehn, Delbrueck (DE); Alexander Redenius, Braunschweig (DE); Uwe Diekmann, Paderborn (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 298 days.

(21) Appl. No.: 12/589,117

(22) Filed: Oct. 16, 2009

(65) Prior Publication Data

US 2010/0139821 A1 Jun. 10, 2010

(30) Foreign Application Priority Data

Oct. 16, 2008 (DE) ..... 10 2008 051 992

(51) Int. Cl.

| | |
|---|---|
| ***C22C 38/34*** | (2006.01) |
| ***C22C 38/32*** | (2006.01) |
| ***C22C 38/48*** | (2006.01) |
| ***C21D 8/00*** | (2006.01) |

(52) U.S. Cl. ..... 148/333; 148/334; 148/335; 148/336; 148/649; 148/645; 148/648; 148/653; 148/654

(58) Field of Classification Search ..... 148/320, 148/645–654, 333–336; 420/104–115, 117
See application file for complete search history.

(56) References Cited

U.S. PATENT DOCUMENTS 4,141,724 A * 2/1979 Brickner et al. ..... 420/104

FOREIGN PATENT DOCUMENTS

DE 10 2007 033 950 A1 1/2008
DE 102006053819 A1 * 5/2008

OTHER PUBLICATIONS

Machine-English translation of Japanese patent 2005-298848, Akamatsu Satoshi et al., Oct. 27, 2005.*
Machine-English translation of Japanese patent 2007-016296, Azuma Masashi et al., Jan. 25, 2007.*

* cited by examiner

*Primary Examiner* — Deborah Yee
(74) *Attorney, Agent, or Firm* — Kriegsman & Kriegsman

(57) ABSTRACT

The present invention, among other things, relates to a method for producing a workpiece by press hardening a semi-finished product, which is distinguished by the fact that the semi-finished product consists of a steel which has a high content of silicon of at least 0.9 wt. %, with a simultaneously small content of manganese of less than 0.9 wt. %, a small carbon content of less than 0.25 wt. %, and a high chromium content of more than 1.20 wt. %, and which by heating is brought to a state in which the structure of the steel that is used is at least partially transformed to austenite, also optionally fully transformed to austenite, and the thus-heated semi-finished product is hot shaped so that after the hot deformation shaping, a structure is present in the workpiece that has a complex phase structure with predominantly martensite and ferrite fractions. In addition, a workpiece is described, which is produced according to this method, as well as uses of such a workpiece.

12 Claims, 4 Drawing Sheets

METHOD FOR PRODUCING A WORKPIECE AND A WORKPIECE

Figure 1:
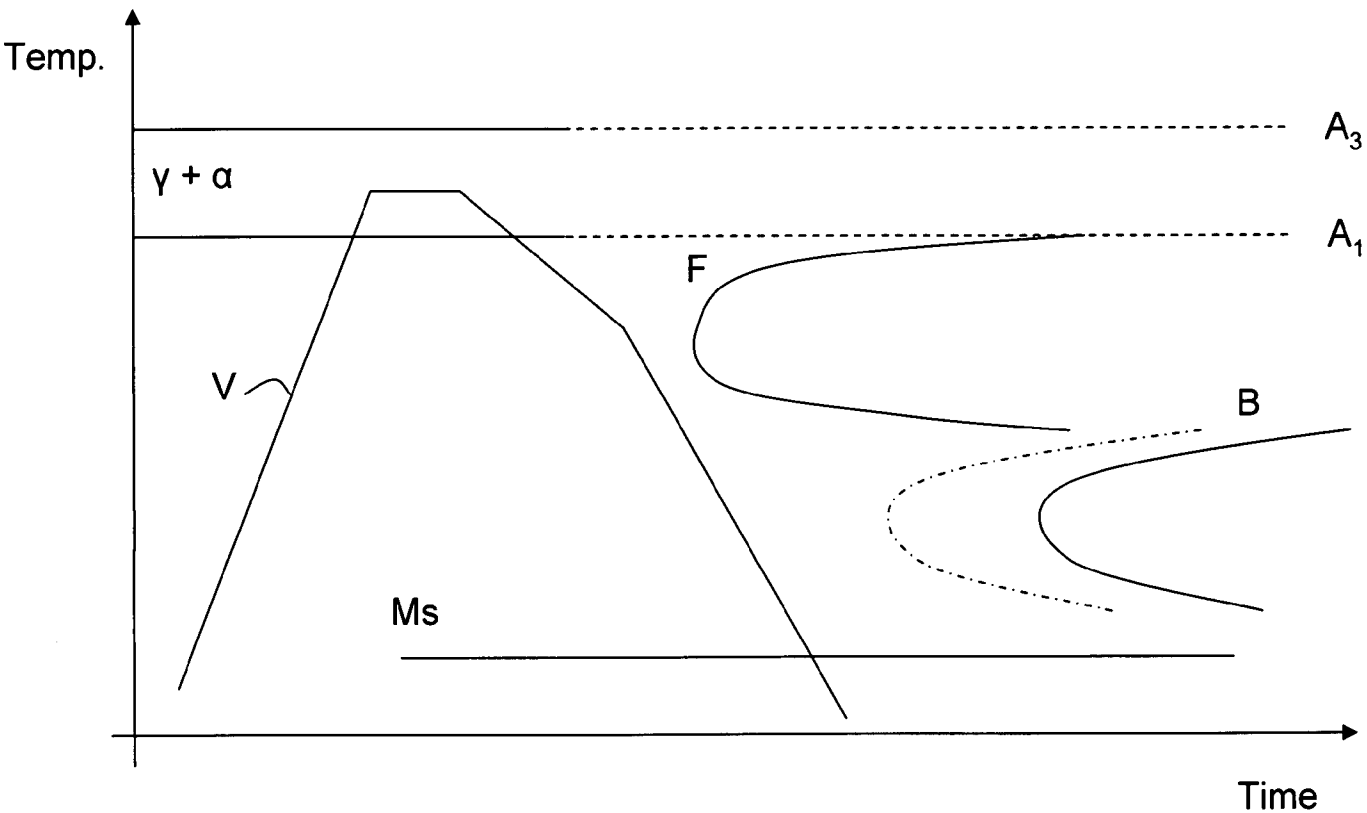

The present application claims the benefit under 35 U.S.C. 119 of the following foreign priority application, the disclosure of which is hereby incorporated by reference: German Patent Application No. 10 2008 051 992.8, filed Oct. 16, 2008.

The present invention relates to a method for producing a workpiece, in particular by press hardening; a workpiece, in particular, a workpiece produced by press hardening; as well as the use of the workpiece.

At the present time, press hardening is standard practice with a heat-treated steel which is principally alloyed with the elements carbon, manganese and boron. A high-strength steel alloy is described, for example, in DE 10 2007 033 950 A1.

The material is generally processed to components either directly or in an indirect hot forming process. In this case, a plate is first cut from the coil and this is then passed through a furnace under a defined atmosphere and with defined parameters. The structure of the material is thus changed from a ferrite-perlite structure into an austenite structure. At the exit from the furnace, the plates heated in this way are grasped by a robot and inserted into the deformation shaping press. This press operates with a cooled tool set, so that during the subsequent deformation shaping, there is an intense cooling of the plate in the tool. The material is transformed from austenite into 100% martensite in this cooling phase. A self-tempering effect, which leads to a precipitation of carbides from the still very brittle martensite at this time point, is achieved by the removal of the shaped component from the tool at a higher temperature. This procedure leads to an increase in toughness of the finished component. The target structure with the material used at the present time, taking into consideration the described process, is thus 100% tempered martensite.

The small elongation at break in the component, however, is listed as problematical by several manufacturers (OEMs). A small residual elongation in the component can lead to brittle crack expansion when loaded under high deformation shaping speeds. Therefore, several manufacturers are striving to increase the elongation at break in the component while maintaining the specifications for strength properties.

The object of the present invention is thus to create a solution by means of which components or workpieces can be provided by press hardening, these components, on the one hand, having an optimal combination of mechanical properties, particularly elongation at break and strength, and, on the other hand, being able to be reliably produced in a cost-effective manner.

The invention is based on the knowledge that this object can be accomplished by producing a suitable complex phase structure in the component.

According to a first aspect, the invention is thus accomplished by a method for producing a workpiece by press hardening a semi-finished product, in which the semi-finished product consists of a steel, which has a high silicon content of at least 0.9 wt. %, preferably in the range of 1-2 wt. %, with a simultaneously small content of manganese of less than 0.9 wt. %, preferably in the range of 0.65-0.8 wt. %, a small carbon content of less than 0.25 wt. %, preferably in the range of 0.19-0.22 wt. %, and a high chromium content of more than 1.20 wt. %, preferably in the range of 1.3-1.5 wt. %. By heating, this semi-finished product is brought to a state, in which the structure of the steel that is used is at least partially transformed to austenite and the thus-heated semi-finished product is hot shaped so that after the hot deformation shaping, a structure is present in the workpiece that has a complex phase structure with predominantly martensite and ferrite fractions.

In the sense of this invention, a complex phase structure is understood to mean a structure in which a mixed structure of at least two structural types is present. The mixed structure particularly preferably consists of a martensite fraction with the remainder being ferrite. According to the invention, it is also possible, however, that other structures, in particular, a remainder of austenite and bainite is present in the complex phase structure.

A targeted change in the martensite structure can be obtained by employing a steel which has a high silicon content. On the other hand, it has been shown that, due to the simultaneously elevated content of chromium, which is alloyed, among other things, in order to increase protection from flaky oxide scale, in particular, the reduced contents of manganese and carbon are equilibrated with respect to the necessary hardenability. Thus, the desired combination of mechanical properties can be obtained with a steel which has the named ratios of alloying elements. If just the carbon content were to be reduced, which generally leads to an increased ductility, in contrast, the strength would be too greatly reduced. In addition, it has been shown that with the high silicon content, the quantity of aluminum that can optionally be employed can be kept small and thus the fatigue strength can be increased. In addition, the silicon also serves as scale protection in the alloy according to the invention.

For reliably establishing these properties, the initial structure of the semi-finished product is heated to a temperature at which it is transformed into austenite, at least partially. This temperature is designated below as the warming temperature. According to one embodiment, the warming temperature lies between the Ac1 and the Ac3 temperature of the steel, i.e., between the temperature at which the transformation into austenite begins and the temperature at which the transformation into austenite is concluded. In this inter-critical range, there is a precipitation of the alpha and gamma phases, but a complete transformation to austenite of the entire structure does not usually occur, of course, in this temperature range. The semi-finished product thus heated and maintained at the warming temperature for a specific time can subsequently be introduced into a press tool. A certain cooling of the semi-finished product occurs due to its introduction into the press tool. A targeted establishing of a complex structure consisting predominantly of martensite and ferrite can be realized due to the composition of the steel employed according to the first aspect of the invention.

An accelerated cooling phase follows, which leads to the transformation of the austenite into martensite, due to the hot deformation shaping of the semi-finished product introduced into the tool. According to the invention, however, a remainder of austenite, in particular lamellar austenite, can also be present in the complex phase structure. Depending on the rate of cooling which is used during the deformation shaping and is influenced, for example, by cooled tools or uncooled tools, the complex phase structure can also comprise a bainite fraction.

In order to increase the elongation properties in the case of steel materials, mechanisms were known previously, such as, for example grain refining, i.e., reducing the average grain boundary. In addition, multiphase structures of non-transforming structural components (dual phase steels) and multiphase structures of partially transforming structural components (TRIP steels) have been proposed. The types of steel with multiphase structure used for the production of workpieces with improved elongation properties are already industrially produced in the normal steel manufacturing process (either as hot strip or as cold strip) and are used for the cold deformation shaping of components. The alloy designs are in part very complicated and the production of the respective strip is possible only within very narrow process windows. An application of these alloy designs to hot deformation shaping is not possible, since these designs are adapted to the hot and cold strip product lines of the steel manufacturer, which clearly differ for the most part with respect to the parameters occurring in the hot-forming process.

In the present invention, it is particularly of advantage that the properties that the finished workpiece will have can be obtained in a manufacturing process with minimal labor expense. In particular, a heat treatment, which must follow the component manufacturing process in the methods of the prior art, is not necessary. Thus, the manufacturing process for the workpiece is overall more profitable. Also, a reduction in strength that accompanies such a heat treatment can be prevented and specifications can thus be fulfilled in a simple way.

Alternatively to heating the semi-finished product to a relatively low temperature between the Ac1 and the Ac3 temperature of the steel used, it is also possible to heat the semi-finished product to a temperature above the Ac3 temperature of the steel. In this way, a complete austenite transformation of the semi-finished product is achieved. The advantage of this embodiment of the method consists of the fact that the initial structure for the method according to the invention is of lesser importance. The requirements for production and, in particular, heat treatment of the initial material, for example, hot strip, prior to the operation of press hardening are thus reduced, so that individual method steps, such as preheating, which is associated with high costs, can be dispensed with.

Due to the steel selected for the semi-finished product in the method according to the first aspect, despite the complete austenite transformation, it can be assured in a simple way that a considerable proportion of the structure will be transformed into ferrite before, during or after the actual hot deformation shaping. In particular, the temperature control is simplified with this composition of the steel. Of course, steel alloys deviating from the steel used in the method according to the first aspect can also be used.

According to another aspect, the present invention relates to a method for producing a workpiece by press hardening a semi-finished product. The method is characterized by the fact that the semi-finished product is heated to a temperature above the Ac3 temperature of the steel used and the thus-heated semi-finished product is hot shaped, so that, after the hot deformation shaping, a structure is present in the workpiece, which has a complex phase structure with predominantly martensite and ferrite fractions.

The temperature control can be adjusted in order to achieve the desired complex phase structure of the alloy used; in particular, for example, the rate of cooling of the semi-finished product can be reduced after heating to the temperature above the Ac3 temperature. Therefore, steel alloying with a ferrite formation range which is shifted to longer times due to the individual alloying elements can also be treated according to the present method.

According to one embodiment, the heating of the semi-finished product comprises a preheating at a temperature which is lower than the Ac1 temperature of the steel employed. This embodiment is particularly of advantage for the method of the invention according to the first aspect, in which a complete austenite transformation optionally does not occur in the heating step. Because of the preheating, irregularities of the initial structure can be eliminated to a certain extent, and thus a partial austenite transformation that is as uniform as possible can be achieved for the semi-finished product.

According to one embodiment, the hot deformation shaping takes place at the beginning of ferrite formation. The beginning of ferrite formation is understood to mean the time point at which the temperature curve of the method enters into the range of ferrite formation (in a time-temperature transformation diagram). This time point of the deformation shaping is particularly preferably selected for the method in which the semi-finished product has been heated to a temperature above the Ac3 temperature of the steel and thus an essentially homogeneous austenite structure is present as the initial structure. Since the deformation shaping occurs at the beginning of ferrite formation, only a small fraction of the ferrite present in the final structure will be attained simply by the temperature control of the semi-finished product after the heating. In this embodiment, the essential part of the ferrite is present instead due to deformation-induced ferrite formation. Before the deformation shaping, a heat treatment in a furnace, which is different from the furnace for the heating of the semi-finished product, is particularly preferred in this embodiment. In the second furnace, after cooling from the heating temperature, the temperature of the semi-finished product can be adjusted in a targeted manner and thus the transformation behavior of the steel employed can be adjusted. Also, in the embodiment in which the hot deformation shaping takes place at the beginning of ferrite formation, the duration of this transformation is brief.

Alternatively, it is also possible, of course, that the hot deformation shaping takes place toward the end of the ferrite formation. The end of the ferrite formation is understood to mean, in particular, the time point at which the temperature curve of the method exits from the range of ferrite formation (in a time-temperature transformation diagram). This time point of the deformation shaping is particularly preferably selected for the method in which the semi-finished product has been heated to a temperature above the Ac3 temperature of the steel and thus an essentially homogeneous austenite structure is present as the initial structure. In this embodiment, the ferrite formation is essentially determined by the temperature control. The structural diagram can thus be established and reproduced more precisely, independently from the shape of the workpiece. In addition, a ferrite is obtained which has an increased yield point. The deformation shaping and the cooling of the semi-finished product associated therewith in this embodiment essentially lead to the fact that the remaining austenite is transformed into martensite in a targeted manner and a bainite formation is inhibited to the greatest extent.

The semi-finished product can be subjected to an air cooling prior to the hot deformation shaping according to the present invention. This can be achieved by transferring the semi-finished product to a tool or also in the furnace that was used for heating the semi-finished product or in a furnace that is connected downstream to the furnace for heating the semi-finished product. Of course, other cooling mechanisms can also be applied; for example, a gas or water cooling can be provided. Due to the targeted cooling of the semi-finished product according to the present invention, in particular, in the case of semi-finished products that are essentially completely transformed into austenite and, in particular, have been heated to a temperature above the Ac3 temperature, the passage of the cooling curve through the ferrite region can be adjusted, particularly the entrance point to this region of ferrite formation. In this way, the structure can be established correspondingly in a manner targeted to the requirements.

According to a preferred embodiment, also in the method of the second aspect of the invention, in which the semi-finished product is heated to a temperature above the Ac3 temperature prior to hot shaping, a steel is used, which has a high silicon content of at least 0.9 wt. %, preferably in the range of 1-2 wt. %, with a simultaneously small content of manganese of less than 0.9 wt. %, preferably in the range of 0.65-0.8 wt. %, a small carbon content of less than 0.25 wt. %, preferably in the range of 0.19-0.22 wt. %, and a high chromium content of more than 1.20 wt. %, preferably in the range of 1.3-1.5 wt. %.

Also, in this case, the increase in silicon content generally has an influence on the increase in the yield point of the workpiece to be produced. The increased silicon content also induces a change according to the invention in the martensite structure in the case of the alloy design of the invention. The remainder of lamellar austenite is responsible for an increased ductility. In addition, the ferrite region is shifted to higher temperatures, in particular by the increased silicon content, so that a dual-phase heat treatment or complex phase treatment is possible to a greater extent. It has been shown that, due to the simultaneously elevated content of chromium, in particular, the reduced contents of manganese and carbon are equilibrated with respect to the necessary hardenability.

According to a preferred embodiment, in addition to iron and unavoidable contaminants, the steel contains the following alloying elements (in wt. %)

C: 0.19-0.22
Si: 1.0-2.0
Mn: 0.65-0.80
B: 0.002-0.003
Cr: 1.30-1.50
Nb: 0.02-0.04.

Due to this alloy composition, which can be produced in a cost-effective manner, the workpiece to be produced can also be produced in a cost-effective manner. It has also been shown that with this alloy composition, for the production of the workpiece according to the invention by hot deformation shaping, due to the niobium content present, an improved fine granularity of the hot strip is achieved and also the grain growth is reduced in the processing procedure. Finally, due to the low carbon content, which is equilibrated, for example, by the elevated chromium fraction with respect to the hardenability, a good weldability of the finished workpiece is also provided.

The steel used in the method of the present invention may additionally contain the following optional elements (in wt. %)

P: max. 0.015
S: max. 0.010
Al: max. 0.010
Ti: max. 0.010
Mo: max. 0.08
Cu: max. 0.20
Ni: max. 0.20.

According to another aspect, the present invention relates to a workpiece made of a steel alloy which was produced by hot deformation shaping, in particular, press hardening a semi-finished product and has a complex phase structure, which predominantly consists of martensite and ferrite, wherein the martensite fraction is larger than the ferrite fraction. Such a workpiece according to the invention has an optimal combination of mechanical properties, in particular, elongation at break and strength and can be produced simply and cost-effectively. Due to the establishment of a complex phase structure, in which the martensite fraction is larger than the ferrite fraction, in particular, the essential strength usual for workpieces is provided. An increase of the elongation properties in steel materials has been achieved previously with known mechanisms. Included here, in particular, is grain refining, i.e., reducing the average grain boundary, as well as multiphase structures of untransforming structure components (dual phase steels) and multiphase structures of partially transforming structure components (TRIP steels). The types of steel with multiphase structure used for the production of such workpieces with improved elongation properties are industrially produced in the normal steel manufacturing process (either as hot strip or as cold strip) and are used for the cold deformation shaping of components. The alloy designs are in part very complicated and the production of the respective strip is possible only within very narrow process windows. An application of these alloy designs to hot deformation shaping is not possible, since these designs are adapted to the hot and cold strip product lines of the steel manufacturer, which clearly differ for the most part with respect to the parameters occurring in the hot-forming process.

The workpiece according to the invention, in contrast, which is produced by hot deformation shaping, in particular hot press hardening, can be produced on a large technical scale and can be adapted in a targeted manner to individual requirements for the properties.

According to one embodiment, the structure of the workpiece has a remainder of austenite in addition to martensite and ferrite. The remainder is particularly present as lamellar austenite. The ductility of the workpiece is increased thereby and therefore, this can serve for applications in which ductility is critical.

The workpiece according to the invention preferably consists of a steel which, in addition to iron and unavoidable contaminants, contains the following alloying elements (in wt. %)

C: 0.19-0.22
Si: 1.0-2.0
Mn: 0.65-0.80
B: 0.002-0.003
Cr: 1.30-1.50
Nb: 0.02-0.04.

The steel of which the workpiece consists, particularly preferably, additionally but optionally, has at least one of the following and preferably all of the following alloying elements (in wt. %):

P: max. 0.015
S: max. 0.010
Al: max. 0.010
Ti: max. 0.010
Mo: max. 0.08
Cu: max. 0.20
Ni: max. 0.20.

Particularly preferably, the workpiece according to the invention possesses an elongation at break A5 of at least 10%, preferably 13%. These high values of elongation at break are achieved in the case of the workpiece according to the invention by the production process with the process steps contained therein and/or by alloying the steel used for the workpiece. Establishing the complex phase structure, which can be done simply in the present invention, makes it possible to obtain these high values.

Preferably, the workpiece has a tensile strength Rm of at least 1300 MPa, preferably 1300-1600 MPa and, particularly preferably, 1450 MPa. This high strength is attained for the most part due to the martensite present in the structure.

The workpiece is preferably produced by the method of the invention according to the first or second aspect of the invention.

According to another aspect, the present invention relates to the use of a workpiece according to the invention as a structural part of the autobody of a motor vehicle. For example, the workpiece can be used as B pillars, A pillars, door impact bars or bumpers of a vehicle. In addition, the use of the workpiece of the invention as a chassis part of a motor vehicle, for example, of the steering wheel or of torsion profiles is also the subject of the invention. Also, the use of the workpiece of the invention as a subframe for motor vehicles, such as, for example, longitudinal and crosswise bars of pipe or of sheet metal, as well as suspension parts, such as, for example, long and short arm suspension, is also a subject of the invention. Finally, the workpiece according to the invention can be used as high-strength steel pipe. Further examples of applications for the workpiece according to the invention are pipe stabilizers, pipe drive shafts and structural parts. The workpiece according to the invention, which is based on the combination of mechanical properties, particularly, strength and elongation at break, is particularly suitable for these uses. Also, the low costs due to the preferred alloys and production process employed are advantageous for the use of the workpiece.

Advantages and features, which were described relative to the method according to the first aspect of the invention, are valid—insofar as they are applicable—also for the method according to the second aspect of the invention, the workpiece according to the invention and the uses according to the invention, and vice versa.

Figure 2:
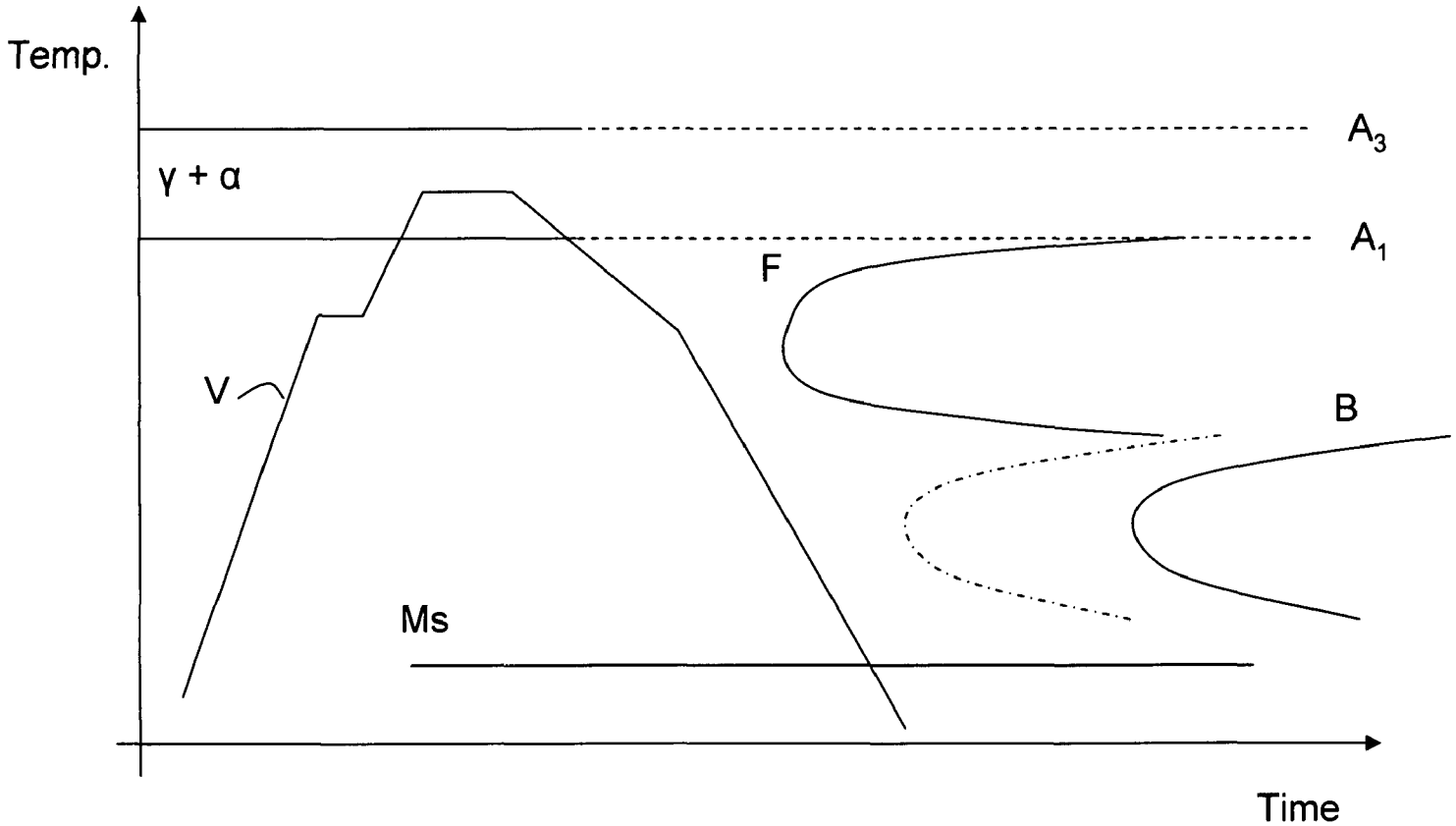
Figure 3:
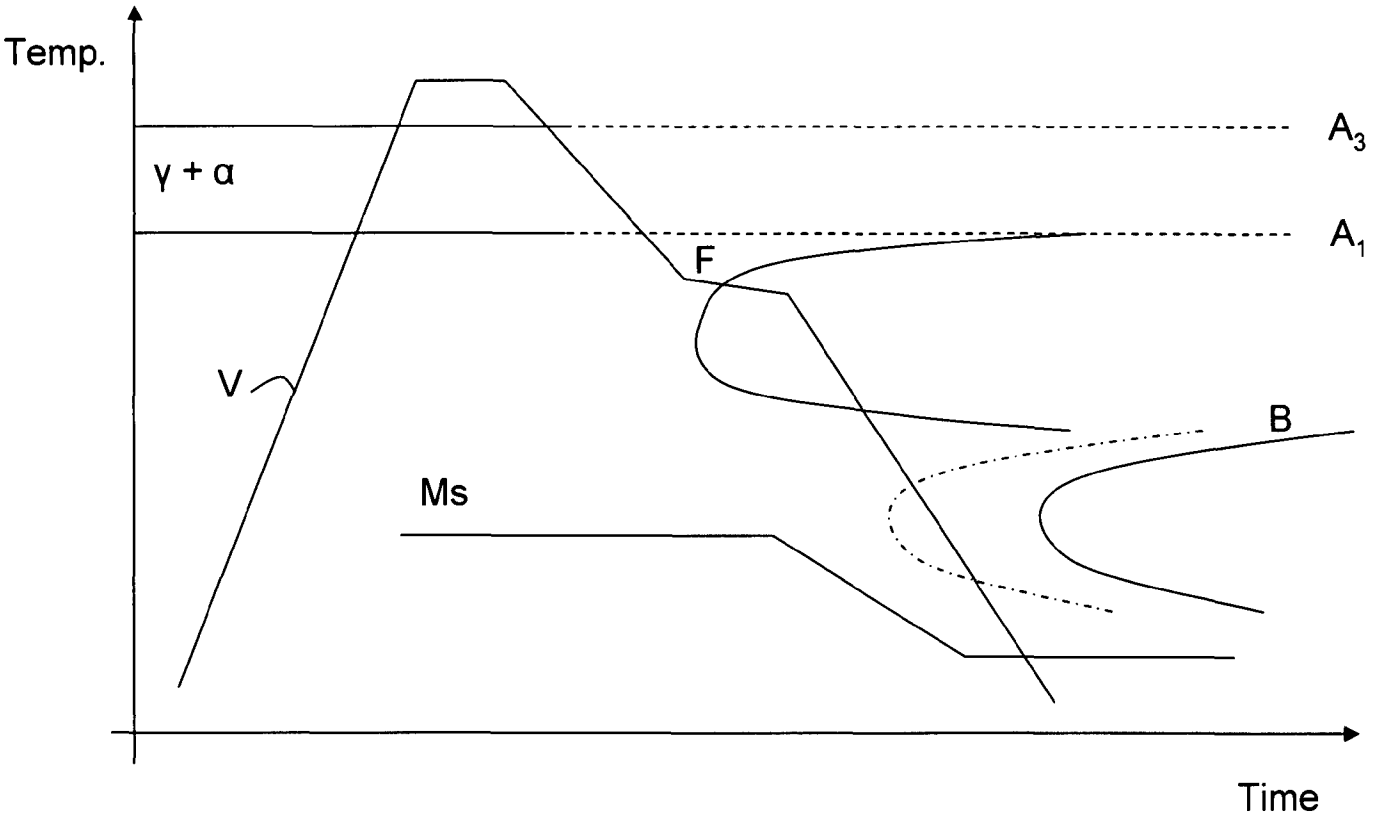
Figure 4:
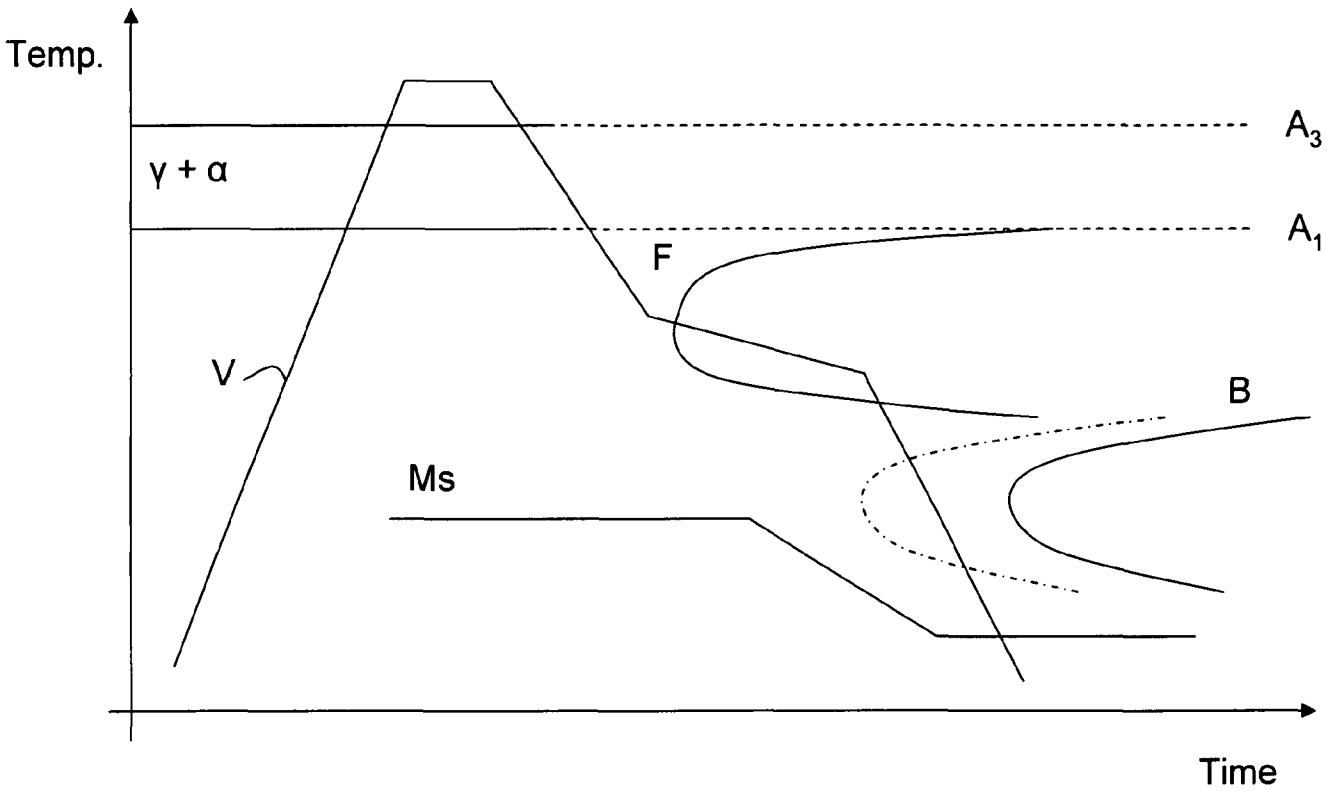

The invention will be described in the following again on the basis of possible embodiment examples with reference to the appended figures. Here:

FIG. 1: shows a schematic time-temperature transformation diagram for an alloy with a method course of a first embodiment of the method of the invention according to the first aspect;

FIG. 2: shows a schematic time-temperature transformation diagram for an alloy with a method course of a second embodiment of the method of the invention according to the first aspect;

FIG. 3: shows a schematic time-temperature transformation diagram for an alloy with a method course of a first embodiment of the method of the invention according to the second aspect; and FIG. 4: shows a schematic time-temperature transformation diagram for an alloy with a method course of a second embodiment of the method of the invention according to the second aspect.

In the case of the example of embodiment shown in FIG. 1, the semi-finished product is brought from an initial temperature to a warming temperature, which lies, for example, in the inter-critical range, i.e., between the Ac3 temperature and the Ac1 temperature of the steel. The semi-finished product is maintained at this temperature for a specified amount of time, and then subsequently is taken out of the furnace and introduced into a tool. By taking the semi-finished product out of the furnace, the product cools off and, when it is introduced into the tool, it particularly has a temperature which lies below the Ac1 temperature of the steel that is used. Another furnace is not necessary for this embodiment of the method. As soon as the semi-finished product comes into contact with the tool and the tool acts on the semi-finished product, i.e., deforms it, there occurs an accelerated drop in temperature. Due to the deformation shaping, the product is transformed extensively from the partially austenitized structure of the austenite fraction into martensite. Each time depending on the alloy selected for the method, the bainite region, which is shown schematically in FIG. 1, can be shifted to shorter times. This is indicated in the figure by the dot-dash line. Also, the ferrite region can be shifted to shorter times.

In this embodiment, the final structure is a mixed structure which essentially consists of martensite and ferrite. Small components of austenite as a remainder may also be present. A percentage distribution of 60% martensite and 30% ferrite is possible.

In the second example of embodiment of the method according to the first aspect of the invention, which is shown in FIG. 2, the semi-finished product is brought from an initial temperature to a preheating temperature, which lies below the inter-critical region of the steel used. The semi-finished product is maintained for a specified time at this preheating temperature. Subsequently, the preheated semi-finished product is heated further to a warming temperature, which lies in the inter-critical region, i.e., between the Ac3 temperature and the Ac1 temperature. The semi-finished product is also maintained at this temperature for a specified amount of time, and then subsequently is taken out of the furnace and introduced into a tool. By taking the semi-finished product out of the furnace, the product cools off and, when it is introduced into the tool, it particularly has a temperature which is below the Ac1 temperature of the steel that is used. As soon as the semi-finished product comes into contact with the tool and the tool acts on the semi-finished product, i.e., deforms it, there occurs an accelerated drop in temperature. Due to the deformation shaping, the product is extensively transformed from the partially austenitized structure of the austenite fraction into martensite. Each time depending on the alloy selected for the method, the bainite region and/or the ferrite region, which are shown schematically in FIG. 2, may be shifted to shorter times. This is indicated schematically in FIG. 2 by the dot-dash line for the bainite region.

In this embodiment, the final structure is also a mixed structure which consists essentially of martensite and ferrite. Small components of an austenite remainder may also be present. A percentage distribution of 60% martensite and 30% ferrite is possible.

The method course of a first embodiment of the method according to the second aspect of the invention is shown in FIG. 3. In this embodiment, the semi-finished product is heated from an initial temperature to a temperature above the Ac3 temperature of the steel that is used. The semi-finished product is maintained for a specified time at this temperature. In this way, an essentially homogeneous austenite structure is formed as the initial structure for the subsequent treatment steps. After this, the semi-finished product is cooled in a controlled manner. For this purpose, the semi-finished product can be introduced into another furnace. By transferring the semi-finished product to the other furnace, its temperature first decreases. Preferably, the temperature is adjusted so that it lies below the Ac3 temperature of the steel that is used. From this temperature, there occurs a controlled cooling, for which the temperature course is controlled so that the temperature-time curve for the method enters into the ferrite region and is maintained in this region for a certain amount of time. Particularly in alloys in which the ferrite region covers a small temperature region, the temperature must be maintained nearly constant. The austenite structure formed during the heating phase in the case of the warming temperature is partially transformed to ferrite in this way. Toward the end of the ferrite region, i.e., at the time point when the method curve would approach the edge of the ferrite region with controlled cooling, the hot deformation shaping of the semi-finished product takes place. By the deformation shaping and particularly by the tool, the temperature is further reduced and the austenite that is still not transformed into ferrite will be transformed into martensite. In the schematic representation of the regions of martensite, ferrite and bainite, which are shown in FIG. 3, there is no formation of bainite. It is also possible, of course, that, as indicated by the dot-dash line in FIG. 3, the bainite region can be shifted to shorter times. In this case, the mixed structure, which is obtained by the method according to the invention, can also have specific bainite fractions. In addition, a certain percentage of austenite as a remainder may be present.

Finally, another embodiment of the method according to the second aspect of the invention is shown in FIG. 4. In this way, as also in the example of embodiment shown in FIG. 3, the semi-finished product is heated to a warming temperature above the Ac3 temperature and is maintained at this temperature until an essentially homogeneous austenite is present in the semi-finished product. The semi-finished product is then transferred from the furnace into a second furnace. In the second furnace, the temperature is maintained approximately the same for a shorter time period than in the example of embodiment shown in FIG. 3. In this way, the method curve enters the ferrite region of the time-temperature transformation diagram. Preferably, the method curve enters this region at a high temperature. Then a deformation-induced ferrite formation is brought about by a deformation shaping following the entry into the ferrite region.

A possible alloy which has turned out to be suitable for the method according to the aspects of the present invention has the chemical composition shown in Table 1.

TABLE 1

| C | Si | Mn | B | Cr | Nb | P | S | Al | Ti | Mo | Cu | Ni |
|---|---|---|---|---|---|---|---|---|---|---|---|---|
| 0.19-0.22 | 1.0-2.0 | 0.65-0.80 | 0.0020-0.0030 | 1.30-1.50 | 0.02-0.04 | Max. 0.015 | Max. 0.010 | Max. 0.010 | Max. 0.010 | Max. 0.08 | Max. 0.20 | Max. 0.20 |

Nitrogen (N) can additionally be contained in an alloy for use in the method according to the present invention. Also, the fraction of aluminum can lie above the data shown in Table 1.

With the alloy shown in Table 1, by applying the process steps used according to the invention in the hot forming process, in particular press hardening, the mechanical properties shown in Table 2 are obtained.

TABLE 2

| State | Rp 0.2 (MPa) | Rm (MPa) | A5 (%) |
|---|---|---|---|
| Press hardened, partially transformed to austenite (first aspect of the invention) | 1135 | 1624 | 13 |
| Press hardened, fully transformed to austenite (second aspect of the invention) | 1000-1300 | 1500-1650 | 10 |

A number of advantages can thus be obtained with the present invention. In particular, a cost-effective alloy design is created in which there are hardly any increased costs when compared to known alloys. Also, the alloy which is preferably used for the present invention is a steel material that can be produced technically in all steel mills. In addition, a further increase in the elongation properties can be made possible by taking into consideration changes in the process. This is essentially due to the multiphase structure produced according to the invention, wherein, however, the same strength values as in known steel materials are still achieved. Finally, the weldability of the workpiece is retained as a consequence of the low carbon content and the number of possible applications of the workpiece according to the invention is thus large.

LIST OF REFERENCE SYMBOLS

V Method curve
A1 Ac1 temperature
A3 Ac3 temperature
F Ferrite region
B Bainite region
Ms Martensite start temperature

The invention claimed is:

1. A method for producing a workpiece by press hardening a semi-finished product is hereby characterized in that the semi-finished product consists of a steel, which has a high silicon content of at least 0.9 wt. %, with a simultaneously small content of manganese of less than 0.9 wt. %, a small carbon content of less than 0.25 wt. %, a high chromium content of more than 1.20 wt. %, an aluminum content up to a maximum of 0.01 wt. %, and the remainder being iron and unavoidable contaminants, and which by heating is brought to a state in which the structure of the steel that is used is at least partially transformed to austenite and the thus-heated semi-finished product is hot shaped so that after the hot deformation shaping, a structure is present in the workpiece that has a complex phase structure with predominantly martensite and ferrite fractions.

2. The method for producing a workpiece by press hardening a semi-finished product as claimed in claim 1, further characterized in that the semi-finished product is heated to a temperature above the Ac3 temperature of the steel that is used and the thus-heated semi-finished product is hot shaped so that after the hot deformation shaping, a structure is present in the workpiece that has a complex phase structure with predominantly martensite and ferrite fractions.

3. The method according to claim 1, further characterized in that the heating of the semi-finished product comprises a preheating at a temperature which is lower than the Ac1 temperature of the steel that is used.

4. The method according to claim 1, further characterized in that the hot deformation shaping takes place at the beginning of ferrite formation.

5. The method according to claim 1, further characterized in that the hot deformation shaping takes place at the end of ferrite formation.

6. The method according to claim 1, further characterized in that the semi-finished product is subjected to an air cooling prior to the hot deformation shaping.

7. A method for producing a workpiece by press hardening a semi-finished product is hereby characterized in that the semi-finished product consists of a steel, which has a high silicon content of 1.0-2.0 wt. %, with a simultaneously small content of manganese of 0.65-0.80 wt. %, a small carbon content of 0.19-0.22 wt. %, a high chromium content of 1.30-1.50 wt. %, a boron content of 0.002-0.003 wt. %, a niobium content of 0.02-0.04 wt. %, an aluminum content up to a maximum of 0.01 wt. %, and the remainder being iron and unavoidable contaminants, and which by heating is brought to a state in which the structure of the steel that is used is at least partially transformed to austenite and the thus-heated semi-finished product is hot shaped so that after the hot deformation shaping, a structure is present in the workpiece that has a complex phase structure with predominantly martensite and ferrite fractions.

8. A method for producing a workpiece by press hardening a semi-finished product is hereby characterized in that the semi-finished product consists of a steel, which has a high silicon content of 1.0-2.0 wt. %, with a simultaneously small content of manganese of 0.65-0.80 wt. %, a small carbon content of 0.19-0.22 wt. %, a high chromium content of 1.30-1.50 wt. %, a boron content of 0.002-0.003 wt. %, a niobium content of 0.02-0.04 wt. %, an aluminum content up to a maximum of 0.01 wt. % , a phosphorus content up to a maximum of 0.015 wt. %, a sulfur content up to a maximum of 0.010 wt. %, a titanium content up to a maximum of 0.010 wt. %, a molybdenum content up to a maximum of 0.08 wt. %, a copper content up to a maximum of 0.20 wt. %, a nickel content up to a maximum of 0.20 wt. %, and the remainder being iron and unavoidable contaminants, and which by heating is brought to a state in which the structure of the steel that is used is at least partially transformed to austenite and the thus-heated semi-finished product is hot shaped so that after the hot deformation shaping, a structure is present in the workpiece that has a complex phase structure with predominantly martensite and ferrite fractions.

9. A workpiece made by a method comprising press hardening a semi-finished product, the semi-finished product consisting of a steel, which has a high silicon content of 1.0-2.0 wt. %, with a simultaneously small content of manganese of 0.65-0.80 wt. %, a small carbon content of 0.19-0.22 wt. %, a high chromium content of 1.30-1.50 wt. %, a boron content of 0.002-0.003 wt. %, a niobium content of 0.02-0.04 wt. %, an aluminum content up to a maximum of 0.01 wt. %, and the remainder being iron and unavoidable contaminants, and which by heating is brought to a state in which the structure of the steel that is used is at least partially transformed to austenite and the thus-heated semi-finished product is hot shaped so that after the hot deformation shaping, a structure is present in the workpiece that has a complex phase structure, which consists predominantly of martensite and ferrite, wherein the martensite fraction is larger than the ferrite fraction.

10. The workpiece according to claim 9, further characterized in that the structure comprises a remainder of austenite.

11. The workpiece according to claim 9, further characterized in that it has an elongation at break A5 of at least 10%.

12. The workpiece according to claim 9, further characterized in that it has a tensile strength Rm of at least 1300 MPa.

* * * * *